US006276560B1

(12) United States Patent
Belcastro

(10) Patent No.: US 6,276,560 B1
(45) Date of Patent: Aug. 21, 2001

(54) AUTOMATICALLY SEALING CUP

(75) Inventor: Domenic Belcastro, Fraser, MI (US)

(73) Assignee: Niko Products, Inc., Fraser, MI (US)

( * ) Notice: Subject to any disclaimer, the term of this patent is extended or adjusted under 35 U.S.C. 154(b) by 0 days.

(21) Appl. No.: 09/643,609

(22) Filed: Aug. 22, 2000

(51) Int. Cl.[7] ..... A47G 19/22
(52) U.S. Cl. ..... 220/709; 220/714; 220/715
(58) Field of Search ..... 220/709, 714, 220/715, 705, 707

(56) References Cited

U.S. PATENT DOCUMENTS

| | | | | |
|---|---|---|---|---|
| 2,447,870 | | 8/1948 | Polcyn . | |
| 3,967,748 | | 7/1976 | Albert . | |
| 4,712,704 | | 12/1987 | Ramsey et al. . | |
| 4,714,173 | * | 12/1987 | Ruiz | 220/709 |
| 5,150,815 | | 9/1992 | Saklad . | |
| 5,169,016 | | 12/1992 | Hinz, Jr. . | |
| 5,273,172 | | 12/1993 | Rossbach et al. . | |
| 5,339,982 | * | 8/1994 | Tardie | 220/709 |
| 5,465,866 | * | 11/1995 | Belcastro | 220/709 |
| 5,582,320 | * | 12/1996 | Lin | 220/709 |
| 5,897,013 | * | 4/1999 | Manganiello | 220/709 |
| 6,050,433 | * | 4/2000 | Russell et al. | 220/709 |
| 6,116,458 | * | 9/2000 | Dark | 220/709 |

* cited by examiner

*Primary Examiner*—Joseph M. Moy
(74) *Attorney, Agent, or Firm*—Artz & Artz, P.C.

(57) ABSTRACT

An improved automatically sealing cup (100) ("cup device") includes a compression member (152), a one-way air valve (144), and releasable handle (104). A lid (106) is releasably mated to a cup (118) in order to cover a cup opening (120) of the cup (118). The lid (106) has a pair of tapered slots (110), a lid port (122), and an aperture (142) integrally formed therein. The tapered slots (110) are subject to selectively receive and release a handle (104). The handle (104) is pivotally attached to the lid (106) and moveable between a sealed configuration and an unsealed configuration. The handle (104) comprises a compression member (152) and a handle hole (154). The handle hole (154) is offset from an exterior tubular portion (146) of the lid port (122) such that a flexible tube (114) engaged to the exterior tubular portion (146) and passing though the handle hole (154) is compressed by the compression member (152) in the sealed configuration. A one-way air valve is (144) positioned in the cup device (100) to allow air to enter the cup device (100) and prevent fluid from leaking out therefrom.

23 Claims, 3 Drawing Sheets

AUTOMATICALLY SEALING CUP

TECHNICAL FIELD

The present invention relates generally to drinking cups, and more particularly concerns an improved automatically sealing cup which has a lid that automatically seals the cup from spilling whenever the cup is not being used.

BACKGROUND OF THE INVENTION

Cups are drinking vessels in common use today. A typical cup has an opening through which a person may sip or place a straw to withdraw the beverage. Users drink from cups under a wide variety of circumstances in which the beverages are highly susceptible to being unintentionally spilled. These circumstances include, for example, operation of a vehicle, participation in sports, walking, etc. Due to the fluid nature of beverages, spills commonly occur through the open mouths of cups when the cups are jarred, tipped, dropped, or subjected to sudden movements. Since users obviously wish to prevent accidental spills, securing the beverage within the cup is important.

One proposed solution for eliminating accidental spills associated with cups employs the use of a lid that snaps onto the rim of a cup. These lids are commonly found in fast food restaurants and coffee outlets. The lid has one or more holes to allow a user to access the beverage. By reducing the size of the opening through which the beverage exits the cup, the likelihood of spills is subsequently reduced. However, these lids fail to eliminate accidental spills. The beverage can still escape through the openings despite their reduced size. For instance, while in the upright position the beverage can splash out of the cup through the openings if it is jarred. Alternatively, if the cup is tipped onto its side, the beverage can still pour out of the cup through the openings. If the cup is dropped, the lid can be dislodged from the cup and the entire contents of the cup can be lost.

Another proposed solution involves a cup and a lid that is secured to the cup by a threading engagement. One variation of this solution further requires a lid having a hole formed therein for the purpose of allowing a straw to pass through the lid. This variation also includes a cap to be manually placed on the end of the straw in order to seal the beverage within the cup. Another variation involves a pop-up vent on the lid which seals the cup when the vent is manually pushed down and permits beverage to exit the cup when the vent is pushed up. In both variations, the threading engagement secures the lid to the cup to prevent the lid from being dislodged from the cup if it is dropped. Both variations also effectively prevent a beverage from splashing out of the cup if the cup is jarred in a substantially upright position. However, unless the user manually places the cap onto the straw or pushes down the pop-up vent, the beverage can spill out of the cup if it is tipped onto its side.

Yet another proposed solution is an automatically sealing cup as disclosed in U.S. Pat. No. 5,465,866. Unfortunately, while the cup disclosed therein has much improved sealability, small amounts of beverage can still leak out of this cup while the cup is in a sealed configuration. Further, it is difficult to clean portions of the cup. This is disadvantageous in that if these cups are frequently reused, such as for children, they must be cleaned and washed before and after each use.

Therefore, a need exists for an improved automatically sealing cup, and for a cup which eliminates spills while it is in a sealed configuration. Also, there is a need for such a cup which further permits the user to readily clean the entire cup device.

SUMMARY OF THE INVENTION

It is an object of the present invention to provide an improved automatically sealing cup that completely blocks communication between the interior of the cup and the exterior of the cup when the cup is in a sealed configuration.

It is another object of the present invention to provide an improved automatically sealing cup that is constructed in such a manner that a user can easily clean the entire cup.

In accordance with the above and other objects of the present invention, an improved automatically sealing cup ("cup device") is provided. The cup device includes a cup that is releasably mated to a lid having a lid port formed therein. A flexible tube is coupled to the lid port in order to allow open communication between the interior of the cup device and the exterior of the cup device. A handle is pivotally connected to the lid and is moveable between a sealed configuration and an unsealed configuration. The handle has a compression member that pinches closed the flexible tube when the handle is in the sealed configuration. The handle further comprises a handle hole formed therein to allow for passage of the flexible tube. Further, the handle hole is offset from the lid port in order to assist the compression member in pinching closed the tube.

A biasing member is integrally formed with the lid such that the biasing member biases the handle to the sealed configuration. Unless the user applies pressure to the handle, the cup remains in the sealed configuration. To allow the beverage to exit the cup device, a user presses the handle to pivot it to the unsealed configuration. In doing so, the compression member is removed from pinching the tube consequently permitting open communication between the interior of the cup device and the exterior of the cup device. As the beverage exits the interior of the cup device through the flexible tube, air enters the interior of the cup device through a one-way air valve. Due to the construction of the valve, no liquid can exit the interior through the one-way air valve.

Additional objects and features of the present invention will become apparent upon review of the drawings and accompanying detailed description of the preferred embodiment.

DETAILED DESCRIPTION OF THE PREFERRED EMBODIMENT

Figure 1:
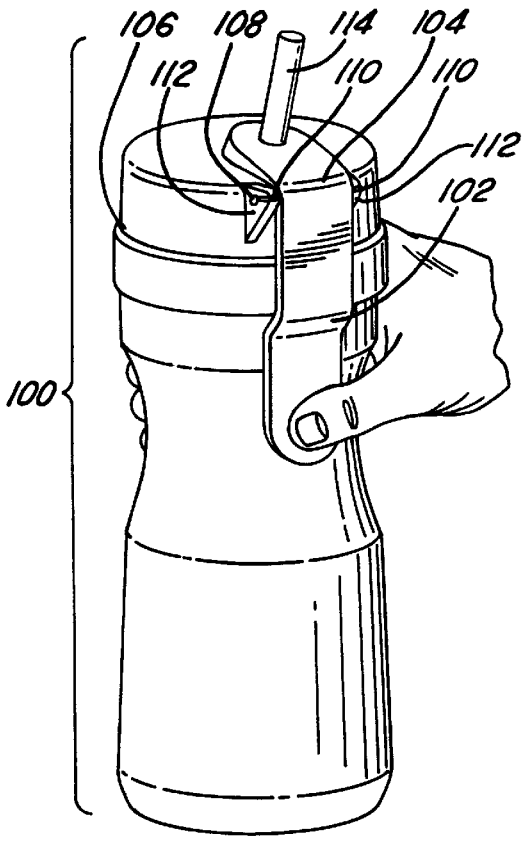
FIG. 1 is a perspective view of an automatically sealing cup according to a preferred embodiment of the present invention, shown in an unsealed configuration due to the application of pressure by a user.

The operation of an improved automatically sealing cup 100 ("cup device") may be understood upon reference to FIG. 1 which generally illustrates the cup device 100 in an unsealed configuration. To permit fluid to exit the cup device 100, the user applies pressure to the first handle segment 102 of the handle 104. This handle 104 is releasably attached to a lid 106 wherein handle nubs 108 on the handle 104 are engaged to tapered slots 110 formed in a pair of ledges 112 projecting from the lid 106. The fluid contained within the cup device 100 can be subsequently extracted therefrom by applying a suction force to a flexible tube 114 that communicates with the interior of the cup device 100. The fluid may exit the cup device 100 only when the user applies pressure to the first handle segment 102.

Figure 2:
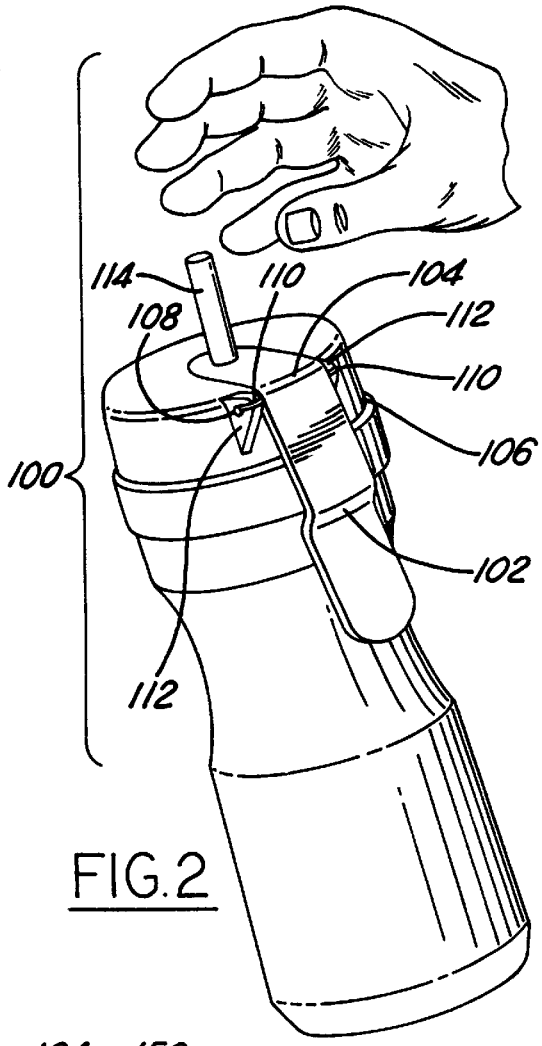
FIG. 2 is a perspective view of an automatically sealing cup according to a preferred embodiment of the present invention, shown in a sealed configuration due to the termination of the application of pressure by a user.
Figure 3:
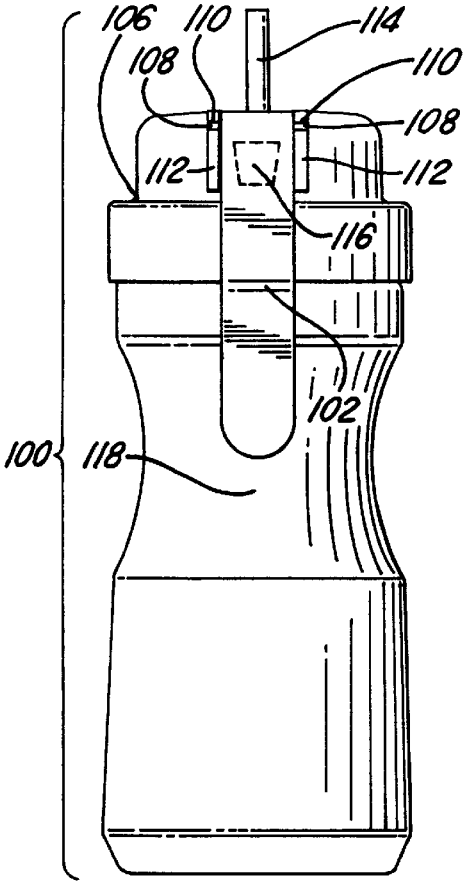
FIG. 3 is a side view of an automatically sealing cup in accordance with a preferred embodiment of the present invention, as shown in a sealed configuration.

Turning to FIGS. 2 and 3, the cup device 100 is illustrated in a sealed configuration. Once the user ceases to apply pressure to the first handle segment 102 of the handle 104, a biasing member 116 pivots the handle 104 to the sealed configuration such that the fluid cannot exit the cup device 100. Being integrally formed within the lid 106, the biasing member 116 contacts the first handle segment 102 of the handle 104 and biases the handle 104 to the sealed configuration. This prevents undesired spills from occurring under various circumstances. These circumstances include, for example, accidentally dropping the cup device 100, storing the cup device 100 in a moving vehicle, and generally jarring the cup device 100 while the user is not drinking from it.

Figure 4:
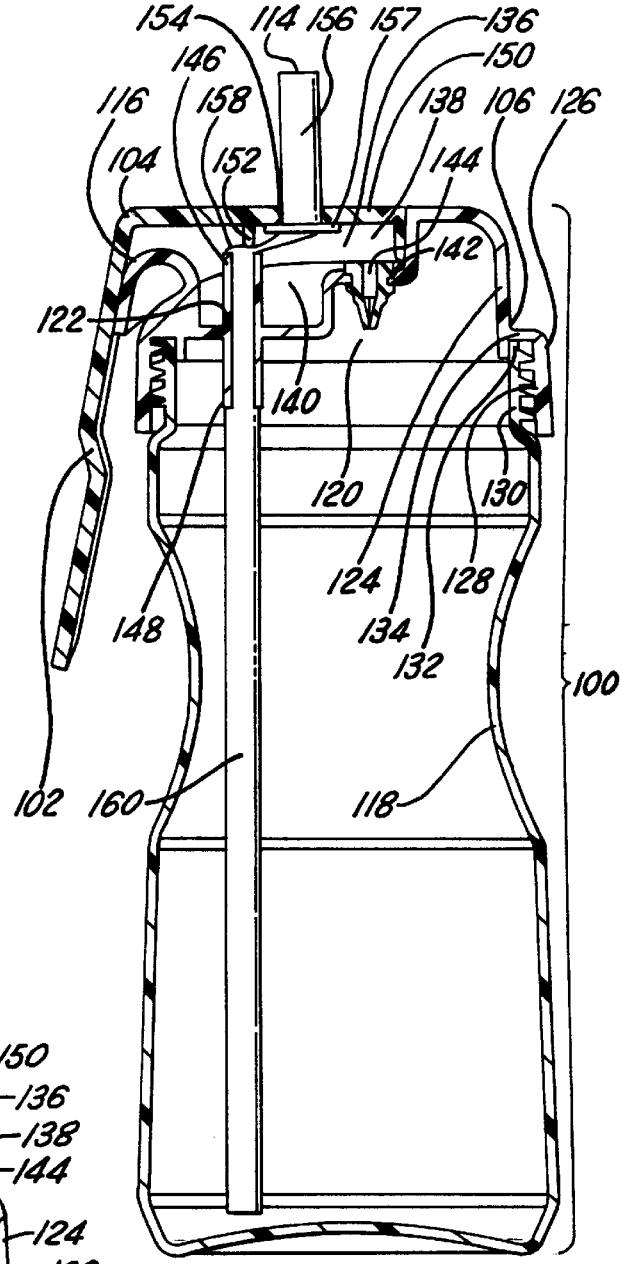
FIG. 4 is a partly sectional side view of an automatically sealing cup according to a preferred embodiment of the present invention, as shown in a sealed configuration.

FIG. 4 is a partly sectional side view specifically illustrating the cup device 100 in the sealed configuration. The cup device 100 includes a cup 118 having a cup opening 120 covered by a lid 106. The lid 106 is releasably mated to the cup 118 such that a user can selectively detach the lid 106 from the cup 118. This association is preferably accomplished by a threaded fastening and may be alternatively achieved by a snap-fit or other conventional attachment mechanism. In a preferred embodiment, the lid 106 and cup 118 are made of plastic.

A fully engaged interface between the lid 106 and the cup 118 permits fluid to exit the cup device 100 only through a lid port 122 formed in the lid 106. The lid 106 has a lid upper portion 124 and a lid lower portion 126. In particular, the lid lower portion 126 has a lip 128 formed therein subject for engaging a cup top portion 130 of the cup 118. As the lid 106 fully engages the cup 118, a rim 132 of the cup opening 120 snugly fits against an abutment 134 on the lid 106 for the purpose of sealing the fluid within the cup device 110.

The lid upper portion 124 of the lid 106 is a partial enclosure with a stepped recess 136 integrally formed therein. The stepped recess 136 has a first recess 138 and a second recess 140. According to the present invention, the first recess 138 has an aperture 142 whereat a one-way air valve 144 is attached. The second recess 140 has the lid port 122 formed therein to permit fluid to exit the cup device 100. The lid port 122 comprises an exterior tubular portion 146 and an interior tubular portion 148. The exterior tubular portion 146 extends from the second recess 140 of the lid 106 upwardly from the cup device. The interior tubular portion 148 extends from the second recess 140 of the lid 106 into the interior of the cup device 100. This lid port 122 provides the only way for fluid to exit the cup device 100 when cup device 100 is in the unsealed configuration and the lid 106 is sealingly interfaced with the cup 118.

The cup device 100 has a handle 104 releasably attached to the lid 106 in accordance with the present invention. As best shown in FIGS. 1 through 3, a pair of ledges 112 projects from opposing sides of the stepped recess 136 within the lid upper portion 124. These ledges 112 have tapered slots 110 for the purpose of receiving and releasing handle nubs 108 of the handle 104. These tapered slots 110 permit the user to selectively remove the handle 104 from the lid in order to allow the user to thoroughly clean the areas of the lid 106 and handle 104 that are otherwise difficult to reach.

FIG. 4 provides a more detailed illustration of the cup device 100 in the sealed configuration. A handle 104 is pivotally attached to the lid 106 and disposed between a sealed configuration and an unsealed configuration. The biasing member 116 biases the handle 104 to the sealed configuration. The association between the handle 104 and the lid 106 is achieved by mating the handle nubs 108 integrally formed in the handle 104 with the tapered slots 110 formed in the lid 106. As mentioned before, the slots 110 permit the user to selectively remove the handle 104 from the lid 106.

The handle 104 includes the first handle segment 102 and a second handle segment 150. The first handle segment 102 is substantially perpendicular to the second handle segment 150. According to the present invention, a compression member 152 for pinching closed the flexible tube 114 in the sealed configuration is integrally formed within the second handle segment 150. A handle hole 154 for the passage of a flexible tube top portion 156 of a flexible tube 114 is also formed within the second handle segment 150. An annular flange 157 on the flexible tube top portion 156 contacts a bottom handle surface 162 of the second handle segment 150. The flange 157 disposes the flexible tube top portion 156 such that a longitudinal axis of the flexible tube top portion 156 is perpendicular to the bottom handle surface 162. The flange 157 also prevents the user from removing the flexible tube 114 through the handle hole 154. This is advantageous in that if the flexible tube 114 is accidentally pulled, such as the case for children, the flexible tube remains attached to the lid port.

A flexible tube bottom portion 158 of the flexible tube 114 is engaged to the exterior tubular portion 146 of the lid port 122. The exterior tubular portion 146 is offset from the handle hole 154 in order to position the axis of the flexible tube 114 substantially perpendicular to the motion of the compression member 152. This design allows the compression member 152 to pinch closed the flexible tube 114. Preferably, the flexible tube 114 is made of a silicone material. Also in accordance with the present invention, the one-way air valve 144 is positioned in the aperture 142 formed in the first recess 138 of the lid 106. The valve 144 allows air to enter the cup device 100 but prevents fluid from exiting the cup device 100 therefrom.

In the illustrated embodiment, the biasing member 116 applies pressure to the first handle segment 102 and pivots the handle 104 to the sealed configuration. The compression member 152 on the second handle segment 150 simultaneously pinches closed the flexible tube 114. Since no fluid can exit through the flexible tube 114, the one-way air valve 144, or the interface between the lid 106 and the cup 118, the cup device 100 remains in a sealed configuration wherein no fluid can leak from the cup device 100.

Figure 5:
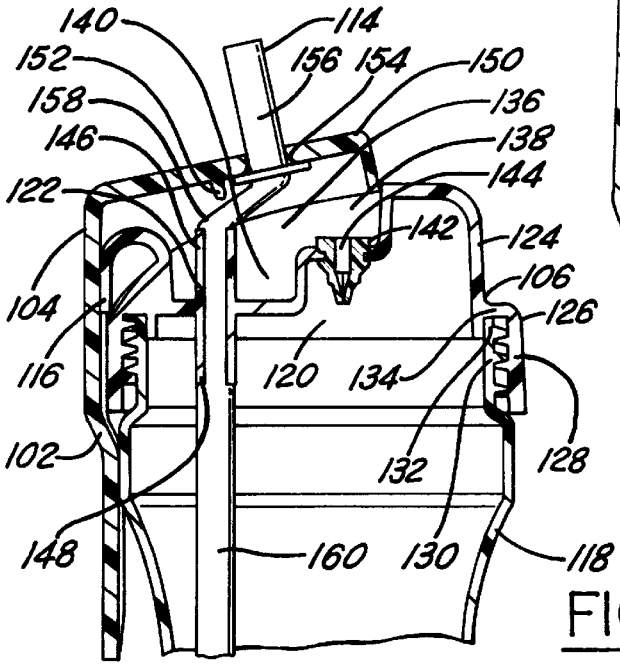
FIG. 5 is a partly sectional side view of an automatically sealing cup according to a preferred embodiment of the present invention, as shown in an unsealed configuration.

Turning now to FIG. 5, a partly sectional side view specifically illustrates the cup device 100 in the unsealed configuration according to the present invention. As the user applies pressure to the first handle segment 102, the handle 106 pivots to the unsealed configuration. In doing so, the compression member 152 attached to the second handle segment 150 is simultaneously removed from the flexible tube 114 so as to allow the flexible tube 114 to rebound to a form wherein fluid may pass. To withdraw fluid from the cup device 100, the user applies a suction force to the flexible tube top portion 156. To facilitate the user in withdrawing fluid from the cup device, air enters the cup device 100 through the one-way air valve 144 as the user withdraws the fluid through the flexible tube 114.

In a preferred embodiment, an interior tube 160 is engaged to the interior tubular member 142 of the lid port 122. Therefore, as the user applies a suction force to the flexible tube 114, the fluid is drawn into the interior tube 142 from the interior of the cup device 100. The fluid is subsequently drawn through the lid port 122 and flexible tube 114 to the exterior of the cup device 100. The interior tube 160 substantially extends into the interior space of the cup device 100 in order to permit the user to withdraw substantially all of the fluid contained within the cup device 100.

Figure 6:
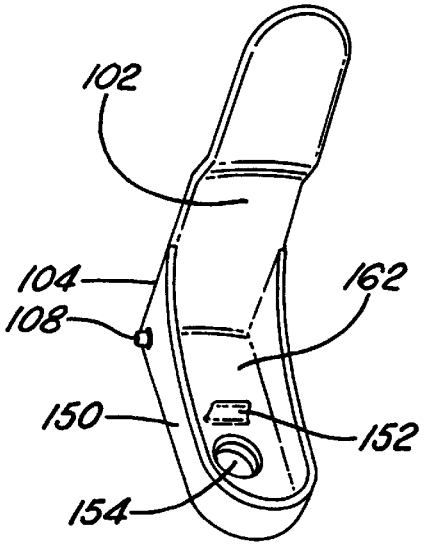
FIG. 6 is a perspective view of the handle of an automatically sealing cup according to a preferred embodiment of the present invention.
Figure 7:
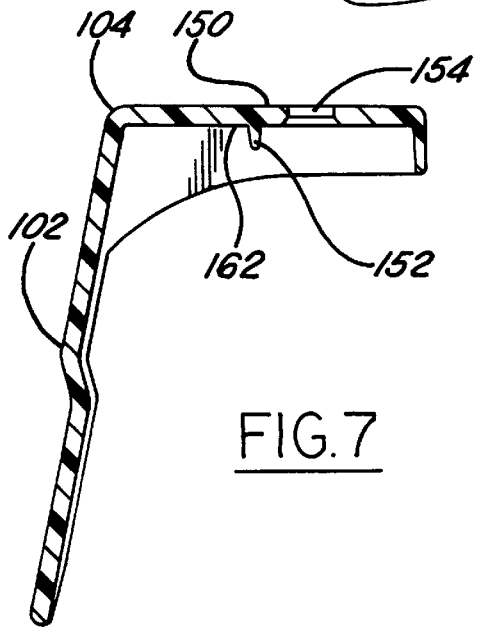
FIG. 7 is a partly sectional side view of a handle of an automatically sealing cup according to a preferred embodiment of the present invention.

In accordance with the present invention, FIG. 6 is a perspective view of the handle 104 that illustrates the compression member 152 integrally formed within the handle 104. More specifically, a partly sectional side view in FIG. 7 shows the compression member 152 projecting downward from a bottom handle surface 162 of the second handle segment 150. This allows the compression member 152 to pinch closed the flexible tube 114 when the handle 104 is pivoted to the sealed configuration. The handle 104 is preferably made of plastic.

Figure 8:
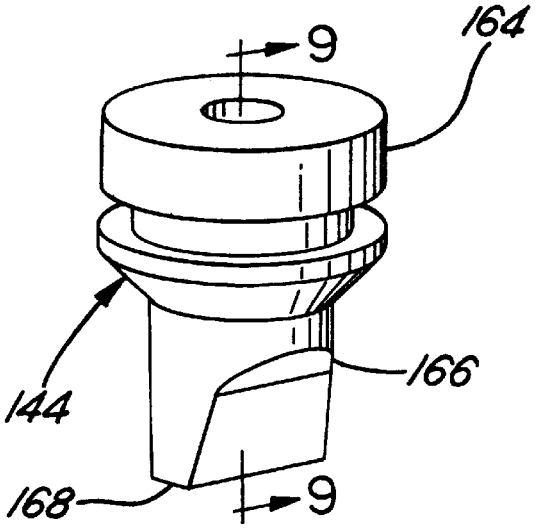
FIG. 8 is a perspective view of a one-way air valve of an automatically sealing cup according to a preferred embodiment of the present invention.
Figure 9:
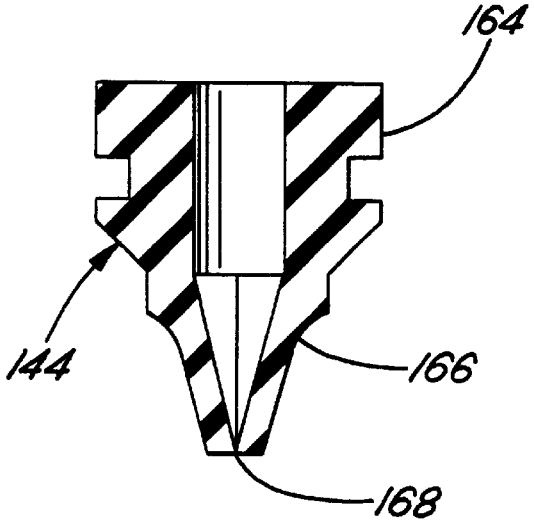
FIG. 9 is a partly sectional side view of a one-way air valve of an automatically sealing cup according to a preferred embodiment of the present invention.

FIG. 8 shows a perspective view of the one-way air valve 144 in accordance with the present invention. In conjunction with a partly sectional side view of the valve 144 as illustrated in FIG. 9, FIG. 8 illustrates a valve top portion 164 and a valve bottom portion 166. In order to allow air to enter the interior space and prevent fluid from exiting the interior space through the valve 144, the valve bottom portion 166 tapers to a slot opening 168. Therefore, air may enter the cup device 100 while it is in the unsealed configuration, and fluid cannot exit the cup device 100 through this valve 144 while the cup device 100 is in either the sealed configuration or the unsealed configuration. The valve member 144 can be made of any conventional material, such as rubber, plastic or an elastomeric material.

Having now fully described the invention, it will be apparent to one of ordinary skill in the art that many changes and modifications can be made thereto without departing from the spirit or the scope of the invention as set forth herein.

In the claims:

1. An improved automatically sealing cup that is selectively unsealable by a user comprising:

a cup having a cup opening;

a lid releasably mated to said cup so as to cover said cup opening;

a lid port formed in said lid;

a flexible tube coupled to said lid port so as to allow communication between the interior area of said cup and the exterior area of said cup, said interior area being in open communication with said exterior area in an unsealed configuration, said interior area being blocked from said exterior area in a sealed configuration;

a compression member attached to a handle, said handle being pivotally attached to said lid and moveable between said sealed configuration and said unsealed configuration; said compression member pinching closed said flexible tube in said sealed configuration, said compression member being selectively removed from said flexible tube in said unsealed configuration; and a biasing member biasing said compression member to pinch closed said flexible tube in said sealed configuration.

2. The improved automatically sealing cup of claim 1 wherein said lid port of said cup comprises an exterior tubular portion and an interior tubular portion, said flexible tube being coupled to said exterior tubular portion.

3. The improved automatically sealing cup of claim 1 wherein a handle has a handle hole formed therein so as to allow for passage of a top portion of said flexible tube.

4. The improved automatically sealing cup of claim 1 wherein a handle hole formed in a handle is axially offset from an exterior tubular portion of said lid port so as to permit the compression member to pinch closed said flexible tube in an unsealed configuration.

5. The improved automatically sealing cup of claim 1 wherein a handle is releasably attached to said lid.

6. The improved automatically sealing cup of claim 1 wherein said biasing member is connected to said lid.

7. The improved automatically sealing cup of claim 1 further comprising a one-way air valve positioned in said cup so as to permit air to enter said interior area through said one-way air valve as fluid exits said interior area through said flexible tube in said unsealed configuration and to prevent fluid from exiting said interior area through said one-way air valve.

8. The improved automatically sealing cup of claim 1 further comprising a one-way air valve having a top surface, a bottom surface, and a channel extending between said top surface and said bottom surface, said channel tapering to a slot opening on said bottom surface.

9. An improved automatically sealing cup that is selectively unsealable by a user comprising:

a cup having a cup opening;

a lid releasably mated to said cup so as to cover said cup opening;

a lid port formed in said lid;

a flexible tube coupled to said lid port so as to allow communication between an interior space of said cup and an exterior space of said cup, said interior space being in open communication with said exterior space in an unsealed configuration, said interior space being blocked from said exterior space in a sealed configuration;

a compression member attached to a handle, said handle being pivotally attached to said lid between said sealed configuration and said unsealed configuration, said compression member pinching closed said flexible tube in said sealed configuration, said compression member being selectively removed from said flexible tube in said unsealed configuration;

a biasing member biasing said compression member to pinch closed said flexible tube in said sealed configuration; and a one-way air valve positioned in said cup so as to permit air to enter said interior space through said one-way air valve as fluid exits said interior space through said flexible tube in said unsealed configuration and to prevent fluid from exiting said interior space through said one-way air valve.

10. The improved automatically sealing cup of claim 9 wherein a lid port of said cup comprises an exterior tubular portion and an interior tubular portion, said flexible tube coupling to said exterior tubular portion.

11. The improved automatically sealing cup of claim 9 wherein a handle has a handle hole formed therein so as to allow for passage of a top portion of said flexible tube.

12. The improved automatically sealing cup of claim 9 wherein a handle hole formed in a handle is offset from an exterior tubular portion of said lid port so as to permit the compression member to pinch closed said flexible tube in an unsealed configuration.

13. The improved automatically sealing cup of claim 9 wherein a handle is releasably attached to said lid.

14. The improved automatically sealing cup of claim 9 wherein said biasing member is connected to said lid.

15. The improved automatically sealing cup of claim 9 wherein said one-way air valve has a top surface, a bottom surface, and a channel extending between said top surface and said bottom surface, said channel tapering to a slot opening on said bottom surface.

16. An improved automatically sealing cup that is selectively unsealable by a user comprising:

a cup having a cup opening;

a lid releasably mated to said cup so as to cover said cup opening;

a lid port formed in said lid;

a flexible tube coupled to said lid port so as to allow communication between the interior of said cup and the exterior of said cup, said interior space being in open communication with said exterior space in an unsealed configuration, said interior space being blocked from said exterior space in a sealed configuration;

a compression member pinching closed said flexible tube in said sealed configuration, said compression member being selectively removed from said flexible tube in said unsealed configuration;

a biasing member biasing said compression member to pinch closed said flexible tube in said sealed configuration; and a handle having said compression member thereon and a handle hole formed therein for passage of said flexible tube, said handle being pivotally attached to said lid between said sealed configuration and said unsealed configuration, said handle hole being offset from said lid port in said sealed configuration such that said flexible tube passing through said handle hole and said lid port is compressed by said compression member in order to block communication between said interior space and said exterior space, said compression member removed from said flexible tube in said unsealed configuration so as to allow open communication between said interior space andsaid exterior space.

17. The improved automatically sealing cup of claim 16 wherein a lid port of said cup comprises an exterior tubular portion and an interior tubular portion, said flexible tube coupling to said exterior tubular portion.

18. The improved automatically sealing cup of claim 16 wherein a handle has a handle hole formed therein so as to allow for passage of a top portion of said flexible tube.

19. The improved automatically sealing cup of claim 16 wherein a handle hole formed in a handle is offset from an exterior tubular portion of said lid port so as to permit the compression member to pinch closed said flexible tube in an unsealed configuration.

20. The improved automatically sealing cup of claim 16 wherein a handle is releasably attached to said lid.

21. The improved automatically sealing cup of claim 16 wherein said biasing member is connected to said lid.

22. The improved automatically sealing cup of claim 16 further comprising a one-way air valve enmeshed with the improved automatically sealing cup so as to permit air to enter said interior space through said one-way air valve as fluid exits said interior space through said flexible tube in said unsealed configuration and to prevent fluid from exiting said interior space through said one-way air valve.

23. The improved automatically sealing cup of claim 16 further comprising a one-way air valve having a top surface, a bottom surface, and a channel extending between said top surface and said bottom surface, said channel tapering to a slot opening.

* * * * *